US005751208A

United States Patent [19]

Martinez

[11] Patent Number: 5,751,208

[45] Date of Patent: May 12, 1998

[54] TEMPORARY FUSE DISCONNECT SYSTEM

[75] Inventor: Ivan V. Martinez, Livonia, Mich.

[73] Assignee: Alcoa Fujikura Ltd., Brentwood, Tenn.

[21] Appl. No.: 698,015

[22] Filed: Aug. 15, 1996

[51] Int. Cl.[6] ..... H01H 85/02; H01H 85/22

[52] U.S. Cl. ..... 337/198; 337/194; 337/216; 361/835; 439/622

[58] Field of Search ..... 337/198, 194, 337/201, 208, 210, 216, 255, 260, 261; 439/621, 622; 361/835

[56] References Cited

U.S. PATENT DOCUMENTS

| | | | |
|---|---|---|---|
| 3,790,861 | 2/1974 | Sakats | 317/114 |
| 3,800,259 | 3/1974 | Humphreys | 337/10 |
| 3,842,380 | 10/1974 | Granson et al. | 337/6 |
| 4,292,616 | 9/1981 | Andersen | 337/4 |
| 5,145,414 | 9/1992 | Oikawa | 439/621 |
| 5,171,293 | 12/1992 | Umemoto | 439/622 |
| 5,221,217 | 6/1993 | Oikawa | 439/621 |
| 5,224,872 | 7/1993 | Noda | 439/282 |
| 5,277,626 | 1/1994 | Oikawa | 439/621 |
| 5,488,345 | 1/1996 | Seki | 337/186 |
| 5,580,281 | 12/1996 | Takeuchi | 439/621 |

*Primary Examiner*—Gerald P. Tolin
*Assistant Examiner*—Jayprakash N. Gandhi
*Attorney, Agent, or Firm*—Gifford, Krass, Groh, Sprinkle, Patmore, Anderson & Citkowski, P.C.

[57] ABSTRACT

A system for establishing and terminating the flow of electrical current through a circuit which includes a fuse puller which engages and retains a standard plug-in fuse element. The system also includes a housing which supports the fuse puller and associated fuse in a first, raised position which separates the fuse from its corresponding contact terminals, and a second, lowered position in which the fuse contacts the terminals.

9 Claims, 3 Drawing Sheets

TEMPORARY FUSE DISCONNECT SYSTEM

FIELD OF THE INVENTION

This invention relates generally to electrical systems. More particularly, the invention relates to systems for both fusing a circuit and switching electrical power to the circuit.

BACKGROUND OF THE INVENTION

This invention concerns a system for temporarily disconnecting a fuse from a circuit so as to prevent current flow through that circuit. This invention, while not limited to the field of motor vehicles, has particular applicability to motor vehicles and other apparatus which include battery powered electrical systems, and which may undergo long term storage.

When a motor vehicle is to be stored for an extended period of time, it is generally desirable to disconnect at least some of its electrical circuits from the vehicle's battery in order to prevent excessive battery drain. While the majority of circuits may be switched off from the control panel of the vehicle, a number of other circuits, including clocks, semiconductor based control systems and the like continue to draw small amounts of power. Additionally, other circuits may suffer small leakage currents which could deplete the battery and/or cause damage during storage. Finally, it may be desirable to disconnect circuits to lighting systems, the horn and the like to prevent vandalism or tampering. In some instances, disconnection of power was previously accomplished by removing one of the battery terminals from the vehicle; however, connecting and reconnecting the terminal can be difficult. Also, it is often desirable to maintain electrical power to selected circuits in the vehicle, and such cannot be done if the battery is disconnected. An alternative to disconnecting the battery involves removing fuses from those circuits which are to be deactivated. This approach allows for selectable deactivation; however, plug-in fuses of the type generally employed in motor vehicles are difficult to remove and insert; also, it is very easy to lose the fuses during storage.

According to the present invention, there is provided a system for selectably deactivating particular circuits of a vehicle by temporarily removing the fuses therefrom. The system of the present invention allows for the removal, retention and replacement of fuses by a simple mechanical action. The system does not require the use of any specially manufactured fuses, and may be readily adapted to conventional fuse blocks.

It is known in the prior art that electrical current may be switched by mechanically moving a fuse from one position to another. U.S. Pat. No. 3,800,259 discloses a switching system for electrical stoves in which a switch element, having a fuse integral therewith, is pivoted between positions which make and break electrical contact. The system in the '259 patent requires the use of a specially constructed fuse/switch element. U.S. Pat. Nos. 4,292,616 and 3,842,380 both show switching systems in which a cylindrical, cartridge fuse is moved between two positions to open and close a circuit, and U.S. Pat. No. 3,790,861 discloses a high voltage switching assembly wherein a support rack holding a number of high voltage cartridge fuses operates to open and close a circuit.

The present invention, as will be described in detail hereinbelow, provides a switching system in which conventional plug-in fuses, of the type generally employed in motor vehicles, may be utilized as switching elements. The system is simple to implement, and may be readily adapted to presently employed fuse blocks, terminals and hardware. These and other advantages of the present invention will be readily apparent from the drawings, discussion and description which follow.

BRIEF DESCRIPTION OF THE INVENTION

There is disclosed herein a system for selectably establishing and terminating the flow of electrical current through a plug-in fuse of the type which includes a body portion having a pair of contact members projecting therefrom. The system includes a fuse puller which has an upper portion and a first and second arm projecting from the upper portion in a spaced apart relationship along a longitudinal axis of the fuse puller. The arms cooperate to retain a plug-in fuse therebetween, and toward that end each arm includes a retaining portion configured to engage the body portion of the plug-in fuse. The system further includes a housing having an upstanding wall portion which defines a passageway through the housing. The passageway is configured to receive the first and second arms of the fuse puller, together with any fuse which is retained between them. The system also includes a detent assembly which associated with the housing and the fuse puller. The detent assembly operates to selectably retain the fuse puller in the passageway in either a first position or a second position which is displaced along the longitudinal axis of the fuse puller relative to the first position. In operation, displacement of the fuse puller along the longitudinal axis correspondingly displaces the contact members of the fuse so that those members will engage and disengage a terminal socket assembly.

In particular embodiments the housing may comprise a portion of a fuse box cover. In one configuration, the detent assembly includes one or more projections formed on each of the arms, together with corresponding detent ramps. The detent ramps are placed so that each engages the projections on a corresponding arm. The ramps are preferably biasable in a direction transverse to the longitudinal axis of the fuse puller. Preferably, the detent ramps are mounted on resilient arms which project into the passageway. In further embodiments, the upper portion of the fuse puller may include a slot formed therein. This slot may be used to engage a screwdriver to facilitate moving the fuse puller from the first and second position.

The present invention, in one embodiment, comprises a fuse box assembly which operates to selectably establish and terminate electrical communication between a fuse and its corresponding terminals.

DETAILED DESCRIPTION OF THE INVENTION

Figure 1:
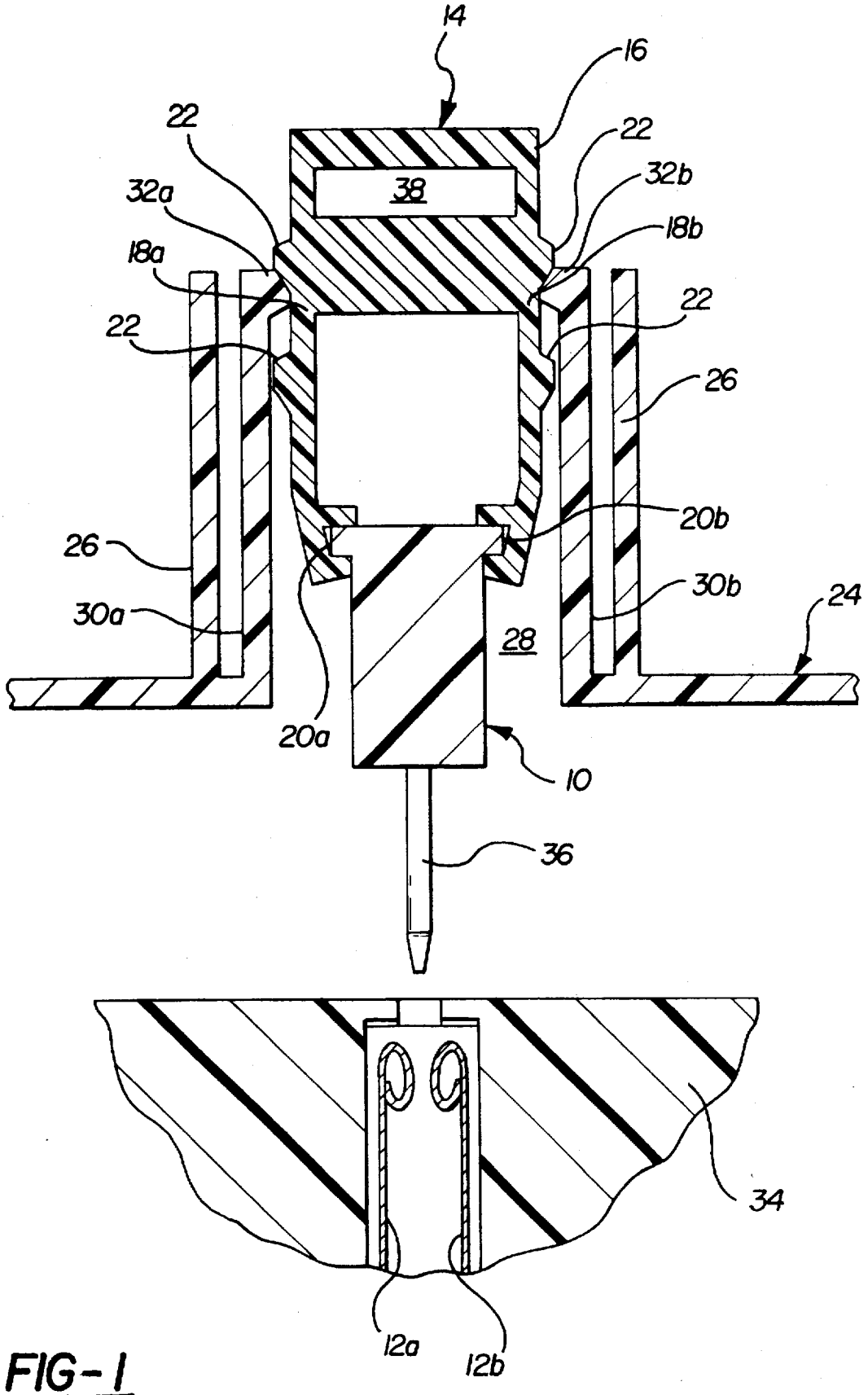
FIG. 1 is a cross-sectional view of a temporary fuse disconnect system structured in accord with the principles of the present invention.
Figure 1A:
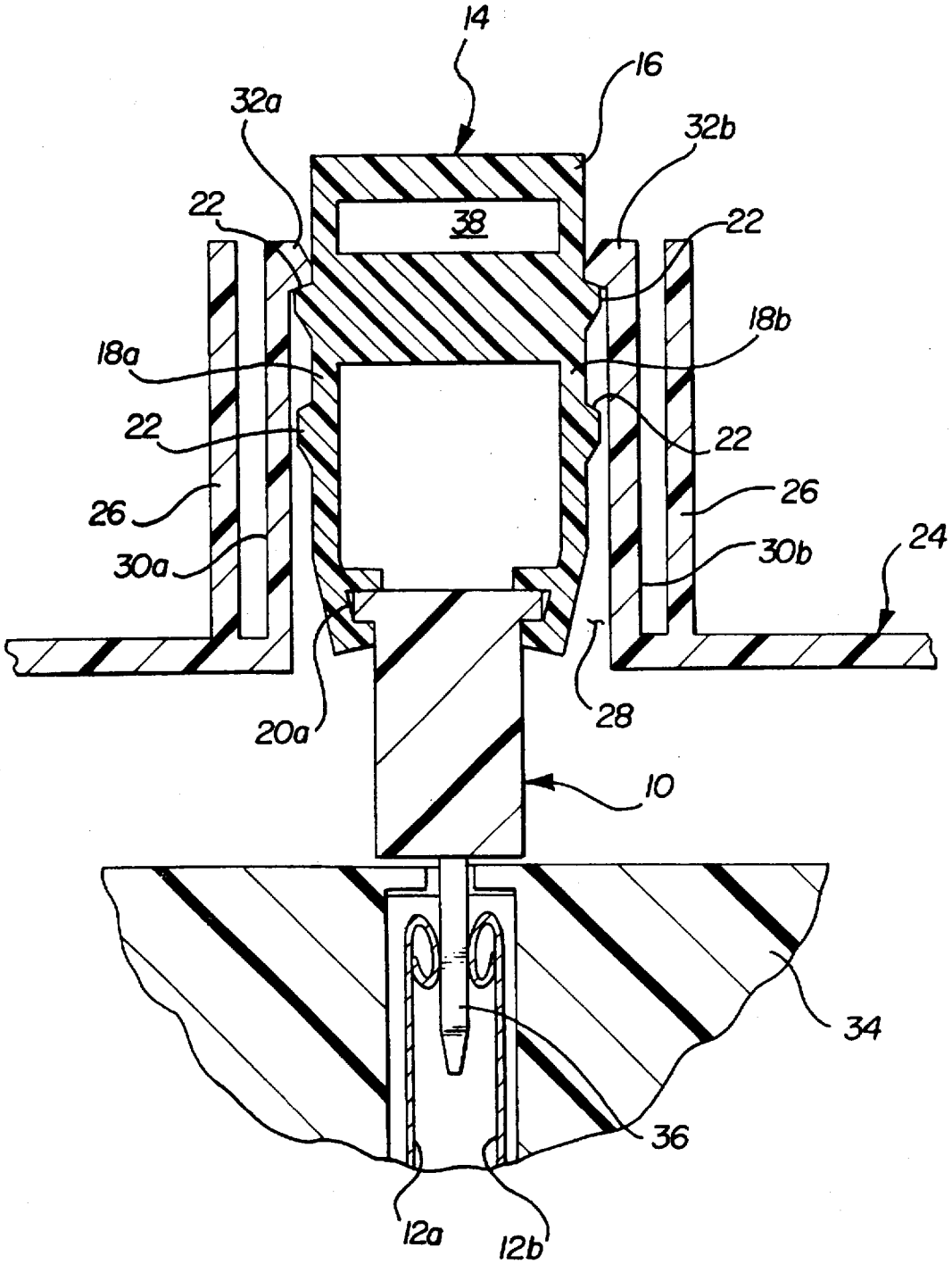
FIG. 1A is a cross-sectional view of the temporary fuse disconnect system of FIG. 1, shown in a closed position.

The present invention is directed to a system for selectably establishing and terminating the flow of electrical current through a plug-in fuse, and FIGS. 1 and 1A illustrate one embodiment of the present invention. Referring now to FIG. 1, there is shown the open configuration of a system by which a plug-in fuse 10 may be selectably connected and disconnected from a pair of fuse terminals 12*a*, 12*b*.

The system of the present invention includes a fuse puller 14 which includes an upper body portion 16 having a first arm 18*a* and a second arm 18*b* projecting therefrom in a spaced apart relationship along a longitudinal axis of the puller 14. The puller 14 is configured to retain a standard plug-in fuse 10, which in the illustrated embodiment is a fuse having a pair of contact blades 36, which engage corresponding terminals 12*a*, 12*b*. As illustrated, the legs 18*a*, 18*b* of the puller 14 each include a notch 20*a*, 20*b* proximate their free end.

The fuse puller is preferably manufactured from a resilient, polymeric material, and the legs 18*a*, 18*b* are somewhat flexible, and this flexibility aids in retaining the fuse 10 therebetween. The fuse puller 14 further includes a series of projections 22 defined thereupon. These projections have a slightly ramped surface; and as will be explained in greater detail hereinbelow, they cooperate with corresponding members to provide a detent action. It is to be noted that the fuse puller 14 is generally similar to fuse pullers presently employed for the insertion and removal of plug-in fuses in motor vehicles. Therefore, the fuse puller 14 of the present invention may be manufactured with minimal change to presently employed tooling.

The system of the present invention further includes a housing portion 24 which operates in cooperation with the fuse puller 14 to provide the selectable establishment and termination of current flow. As illustrated in FIG. 1, the housing 24 includes a wall portion 26 which defines a passageway 28 through the housing 24. The passageway 28 is configured to receive and retain the first and second arms 18*a*, 18*b* of the fuse puller 14 together with any fuse 10 retained thereby.

The housing 24 may take various configurations; however, in the illustrated embodiment, the housing 24 comprises a portion of a lid covering a fuse box. Other variations will be readily apparent to those of skill in the art. The system of FIG. 1 further includes a first and a second resilient arm 30*a*, 30*b* disposed within the passageway 28 defined by the upstanding wall 26 of the housing 24. The arms 30*a*, 30*b* each include a ramp portion 32*a*, 32*b* defined thereupon. The ramp portions 32 are configured to engage corresponding projections 22 on the fuse puller 14 so as to provide a detent action. In the illustrated embodiment, each of the ramp members 32*a*, 32*b* is supported by its respective arm 30 so as to be biasable in a direction generally transverse to the longitudinal axis of the fuse puller 14 when the puller is disposed in the passageway 28. It will be clear from FIG. 1 that the illustrated configuration will provide a detent action wherein the fuse puller may be supported in the passageway in at least two separate positions relative to the longitudinal axis of the fuse puller 14.

Also shown in FIG. 1 is a terminal block 34, only a portion of which is illustrated, which further includes a pair of fuse terminals 12*a*, 12*b* supported therein. The terminals 12*a*, 12*b* are configured and disposed so as to engage, and establish electrical communication with, a blade portion 36 of the fuse 10. A second, generally similar pair of terminals will operate to establish electrical communication with a second blade of the fuse 10.

In the operation of the system of the present invention, electrical communication between the blade 36 of the fuse 10, and the fuse terminals 12*a*, 12*b* may be selectably established by advancing the fuse puller 14 and associated fuse 10 through the passageway 28 so as to insert the blade 36 between the terminals 12*a*, 12*b*. Termination of electrical communication is accomplished by withdrawing the fuse puller. The detent system comprised of the projections 22, ramps 32 and resilient arms 30 will operate to retain the puller 14 in the housing 24 even when the blade 36 of the fuse 10 is removed from the terminals 12*a*, 12*b*. Since the fuse puller 14 and fuse 10 are fixably retained, loss of the fuse is avoided, and electrical connection may be readily reestablished by merely depressing the top portion 16 of the fuse puller 14. It will be noted that the top portion 16 of the fuse puller 14 includes a slot 38 defined therethrough. This slot is configured to receive the blade of a screwdriver, or a like implement, and thereby facilitates lifting of the fuse puller within the passageway 28 or disengagement of the fuse from the terminals 12*a*, 12*b*.

Referring now to FIG. 1A, there is shown the disconnect system of FIG. 1, in its closed position. As illustrated, the fuse puller 14, has been depressed within the passageway 28, thereby advancing the fuse 10 so that its blades 36 engage the fuse terminals 12*a*, 12*b*. In this manner, the fuse 10 operates to complete an electrical circuit. The circuit may subsequently be reopened by withdrawing the fuse puller 14 back to the position shown in FIG. 1.

It is to be understood that modifications and variations of the foregoing are possible within the scope of the present invention. For example, as illustrated, the housing 24 comprises a cover of a fuse box, which cover is supported by fuse box walls (not shown) in spaced apart relationship from a terminal block 34. In those instances where a fuse box cover is not employed, the housing portion of the system of the present invention may be supported directly upon a terminal block; and in some instances, may be an integral portion of the terminal block. In the most preferred embodiment, the system of the present invention is preferably fabricated from durable polymeric material, such as ABS, nylon, reinforced polymers or the like. However, the present invention is not limited to any particular material.

Figure 2:
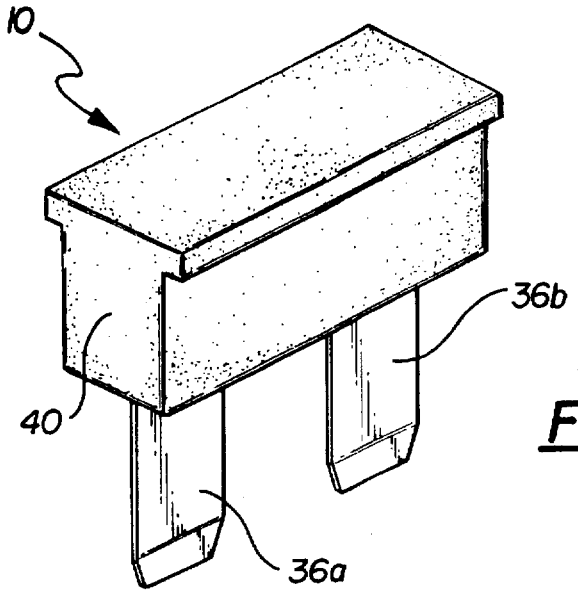
FIG. 2 is a perspective view of one conventional, plug-in fuse of the type which may be employed in combination with the present invention.

Referring now to FIG. 2, there is shown a perspective view of one plug-in fuse 10 of the type which may be employed in combination with the system of the present invention. The fuse 10 includes a body portion 40, which includes a fuse element therein, and a pair of contact members which comprise terminal blades 36*a*, 36*b*. As illustrated, the fuse 10 includes a lip portion formed on the body 40, and, as shown in the figures, the fuse puller is configured to engage this lip. In those instances where differently configured fuses are employed, it would be within the skill of one knowledgeable in the art to appropriately modify the fuse puller, and possibly the housing, so as to accommodate the differently configured fuses. For example, the present invention may be used with cylindrical fuses, of the type in which the contact members comprise either blades projecting from the ends of the cylinder, or electrically conductive caps covering the ends of the cylinder. In the case of cylindrical fuses, the arms of the puller may be appropriately notched to grip and retain the body of the cylinder.

Figure 3:
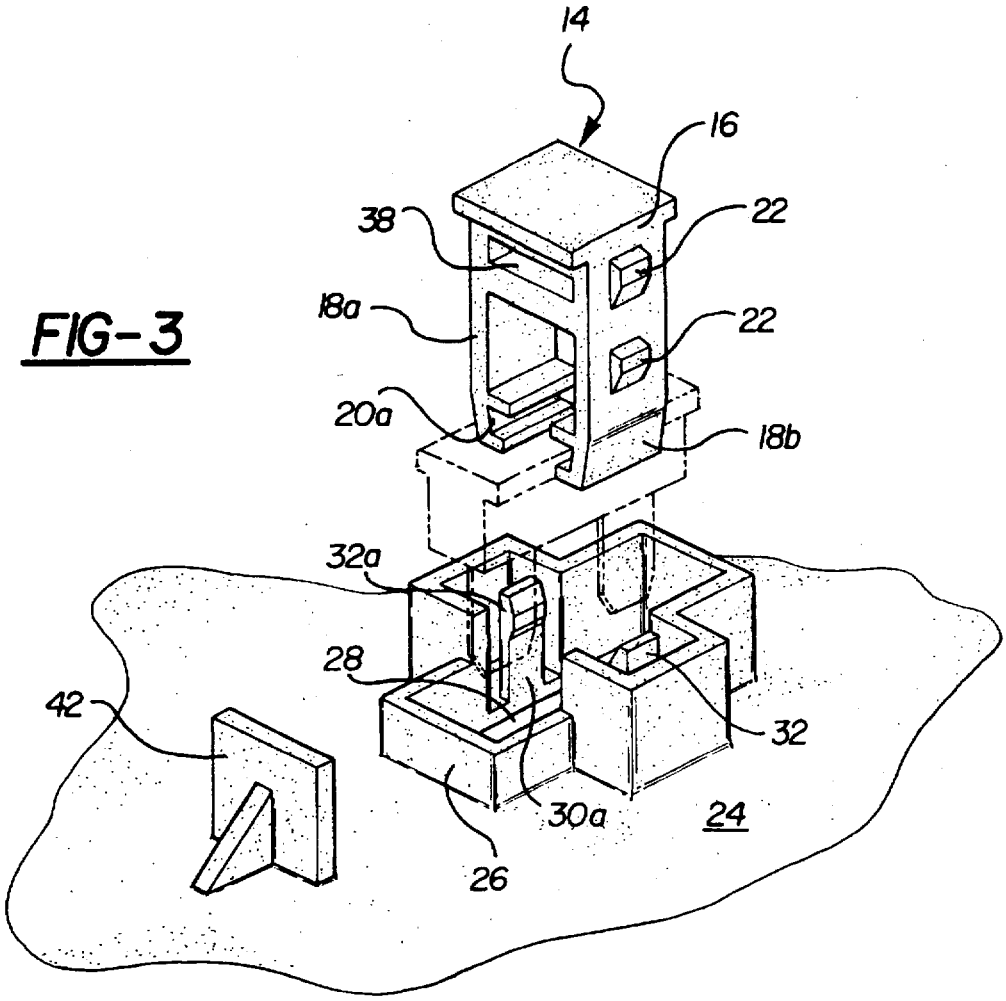
FIG. 3 is an exploded, perspective view of one embodiment of the present invention.

Referring now to FIG. 3, there is shown an exploded, perspective view of a selective disconnect system of the present invention generally similar to that shown in FIGS. 1 and 1A. As shown in FIG. 3 the system includes a fuse puller 14 with a screwdriver slot 38 defined therein. A pair of legs 18*a*, 18*b* depend from the top portion 16 of the fuse puller, and include detent projections 22 defined thereupon. The legs include a groove, for example groove 20*a*, which receives and retains the lip of the fuse. As illustrated, each of the legs 18*a*, 18*b* includes a free end having a slightly ramped surface to enable the fuse puller 14 to be snapped onto the fuse.

The system illustrated in FIG. 3 further includes a housing 24 which again is shown as being a portion of a lid of a fuse box, it being understood that other configurations are also within the scope of the invention. The housing 24 includes an upstanding wall portion 26, which defines a passageway 28 configured to receive the fuse puller 14. FIG. 3 illustrates the detent ramps 32*a*, 32*b* and one of the resilient arms 30*a* associated therewith. Also shown in FIG. 3 is a leverage rib 42 which projects from the planar surface of the housing 24. The leverage rib 42 is an optional feature of the present invention, and provides a fulcrum on which a screwdriver, or similar prying element, may be placed for the purpose of engaging the slot 38 in the fuse puller 14 and lifting the associated fuse out of engagement with its corresponding terminals.

The foregoing drawings, discussion and description are merely meant to illustrate particular embodiments of the present invention, and are not meant to be limitations upon the practice thereof. Numerous modifications and variations of the present invention will be apparent in view of the teaching presented herein. It is the following claims, including all equivalents, which define the scope of the invention.

I claim:

1. A system for selectably establishing and terminating a flow of electrical current through a plug-in fuse of the type which includes a body portion having a pair of contact members projecting therefrom, said system comprising:

a fuse puller including an upper portion and a first and second arm projecting from said upper portion, in a spaced apart relationship along a longitudinal axis of said fuse puller, each arm including a retaining portion configured to engage the body portion of a plug-in fuse so that said fuse is retained by said arms;

a housing having an upstanding wall portion which defines a passageway therethrough which is configured to receive said first and second arms; and a detent assembly including a projection formed on one of said first and second arms, and a ramp, associated with said housing, which is configured to engage said projection, said detent assembly being operable to selectably retain said fuse puller in said passageway in a first position and in a second position which is displaced along said longitudinal axis relative to said first position, whereby displacement of said fuse puller along said longitudinal axis will correspondingly displace the fuse so that the contact members thereof will correspondingly engage and disengage a terminal socket assembly.

2. A system as in claim 1, wherein the contact members of said fuse are configured to engage a terminal socket supported in a fuse box having a cover, and wherein the upstanding wall of said housing is defined by a portion of said cover.

3. A system as in claim 1, wherein the retaining portion of each of said first and second arms comprises a notch.

4. A system as in claim 1, wherein said ramp is disposed on a resilient arm which projects from the upstanding wall portion of the housing and which is biasable in a direction transverse to the longitudinal axis of the fuse puller, when the fuse puller is disposed in said passageway.

5. A system as in claim 1, wherein the upper portion of said fuse puller includes a slot defined at least partway therethrough in a direction transverse to the longitudinal axis of said fuse puller.

6. A system as in claim 1, wherein said detent assembly includes two projections disposed in a spaced apart relationship, along the length of each of said first and second arms, and further includes a first and a second detent ramp, each supported upon a resilient arm projecting from said housing and into said passageway, said first and second arms each being biasable in a direction generally perpendicular to the longitudinal axis of the fuse puller when the puller is disposed in said passageway.

7. A fuse box assembly for selectably establishing and terminating a flow of electrical current through a plug-in fuse of the type which includes a body portion having a pair of contact members projecting therefrom, said system comprising:

a fuse box having a terminal assembly supported within an interior volume thereof, said terminal assembly configured to receive and establish electrical contact with a pair of contact members of a fuse;

a fuse puller including an upper portion and a first and second arm projecting from said upper portion, in a spaced apart relationship along a longitudinal axis of said fuse puller, each arm including a retaining portion configured to engage the body portion of a plug-in fuse so that said fuse is retained by said arms;

a lid configured to engage said fuse box and to cooperate with said fuse box so as to enclose said interior volume, said lid having an upstanding wall portion projecting therefrom which defines a passageway through said lid, said passageway being configured to receive said first and second arms; and a detent assembly associated with said lid and said fuse puller, said detent assembly being operable to selectably retain said fuse puller in said passageway in a first position and in a second position which is displaced along said longitudinal axis relative to said first position, whereby displacement of said fuse puller along said longitudinal axis will correspondingly displace the fuse so that the contact members thereof will correspondingly engage and disengage a terminal socket assembly.

8. A system for selectably establishing and terminating a flow of electrical current through a plug-in fuse of the type which includes a body portion having a pair of contact members projecting therefrom, said system comprising:

a fuse puller including an upper portion and a first and second arm projecting from said upper portion, in a spaced apart relationship along a longitudinal axis of said fuse puller, each arm including a retaining portion configured to engage the body portion of a plug-in fuse so that said fuse is retained by said arms;

a housing having an upstanding wall portion which defines a passageway therethrough which is configured to receive said first and second arms; and a detent assembly associated with said housing and said fuse puller, said detent assembly including two projections disposed in a spaced apart relationship, along the length of each of said first and second arms, and a first and a second detent ramp, each supported upon a resilient arm projecting from said housing and into said passageway, said first and second arms each being biasable in a direction generally perpendicular to the longitudinal axis of the fuse puller when the puller is disposed in said passageway, said detent assembly being operable to selectably retain said fuse puller in said passageway in a first position and in a second position which is displaced along said longitudinal axis relative to said first position, whereby displacement of said fuse puller along said longitudinal axis will correspondingly displace the fuse so that the contact members thereof will correspondingly engage and disengage a terminal socket assembly.

9. A system for selectably establishing and terminating a flow of electrical current through a plug-in fuse of the type which includes a body portion having a pair of contact members projecting therefrom, said system comprising:

a fuse puller including an upper portion and a first and second arm projecting from said upper portion, in a spaced apart relationship along a longitudinal axis of said fuse puller, each arm including a retaining portion configured to engage the body portion of a plug-in fuse so that said fuse is retained by said arms;

a housing having an upstanding wall portion which defines a passageway therethrough which is configured to receive said first and second arms; and a detent assembly associated with said housing and said fuse puller, said detent assembly being operable to selectably retain said fuse puller in said passageway in a first position and in a second position which is displaced along said longitudinal axis relative to said first position, whereby displacement of said fuse puller along said longitudinal axis will correspondingly displace the fuse so that the contact members thereof will correspondingly engage and disengage a terminal socket assembly.

* * * * *